US007186918B2

(12) United States Patent
Swenson et al.

(10) Patent No.: US 7,186,918 B2
(45) Date of Patent: Mar. 6, 2007

(54) ROTATABLE COVER PLATE

(75) Inventors: Robert E. Swenson, Cambridge, WI (US); Mark R. Eckert, Madison, WI (US)

(73) Assignee: Wolf Appliance Company, LLC, Fitchburg, WI (US)

( * ) Notice: Subject to any disclaimer, the term of this patent is extended or adjusted under 35 U.S.C. 154(b) by 68 days.

(21) Appl. No.: 11/100,852

(22) Filed: Apr. 7, 2005

(65) Prior Publication Data

US 2006/0225911 A1 Oct. 12, 2006

(51) Int. Cl.
*H02G 3/14* (2006.01)

(52) U.S. Cl. ..... 174/66; 174/67; 174/135; 220/241

(58) Field of Classification Search ..... 174/66, 174/67, 135; 220/241, 242
See application file for complete search history.

(56) References Cited

U.S. PATENT DOCUMENTS 5,773,760 A * 6/1998 Stark et al. ..... 174/66
6,984,786 B2 * 1/2006 Yano et al. ..... 174/66
7,030,318 B2 * 4/2006 Tufano et al. ..... 174/66

OTHER PUBLICATIONS

Wolf Appliance Company, LLC Engineering Drawing No. 802443 for "Pan Extrusion, Double", unpublished.

Wolf Appliance Company, LLC Engineering Drawing No. 802421 for "Pan Extrusion", unpublished.

Wolf Appliance Company, LLC Engineering Drawing No. 805256 for "Pan Extrusion, Short", unpublished.

* cited by examiner

*Primary Examiner*—Dhiru R. Patel
(74) *Attorney, Agent, or Firm*—Foley & Lardner LLP

(57) ABSTRACT

A device and method for spanning a gap between adjacent surfaces is provided. The device includes a pin or pin plate rotatably connected to a cover plate, preferably using a ball and socket joint. The pin or pin plate, connected to the cover plate, can be inserted into the gap and the cover plate can be rotated to engage the adjacent surfaces, thereby covering the gap.

38 Claims, 8 Drawing Sheets

ROTATABLE COVER PLATE

FIELD OF THE INVENTION

The present invention relates generally to an appliance and, more particularly, to a device for placing between adjacent surfaces to provide a protective and aesthetic cover over a gap that results from a misalignment between the adjacent surfaces.

BACKGROUND OF THE INVENTION

New appliances are continually being developed and existing appliances improved. Consumers purchasing new or improved appliances desire the ability to integrate the new appliances into an existing kitchen layout. Additionally, manufacturers may wish to form customized configurations of appliances for consumers by combining appliance modules. For example, a composite cooking appliance can be formed by combining a range module placed adjacent to a griddle module. By providing a selection of different appliance modules, custom configurations can be provided which are tailored to the requirements of a particular customer.

It is generally the case that a gap will be found between adjacent appliances or appliance modules when those appliances or appliance modules are positioned adjacent to each other. This gap will typically have a horizontal component, for example because the adjacent edges of the adjacent appliances or appliance modules are not exactly parallel, or because of other variations in the sizes of the appliances or appliance modules. The gap between adjacent appliances or appliance modules will also have a vertical component, for example because the adjacent edges of the adjacent appliances or appliance modules are not exactly the same height. The gap can be especially large when combining appliances or appliance modules from different manufacturers.

Similar problems are found when placing appliances into kitchen cabinetry and countertops. When kitchen cabinetry and countertops are built to surround an appliance, the horizontal space in the cabinetry and countertops for the appliance will generally be made a little larger than the appliance requires, to make sure the appliance fits into the space. This is especially true when the countertops are formed of granite or an engineered material which is not easily trimmed once placed into a final position.

Because the consequences of making the horizontal space for the appliance a little too small are much worse than making the horizontal space for the appliance a little too large, the horizontal space is commonly made a little oversize to ensure the appliance fits, even though this means there will be at least some gap between the appliance and the countertop. Although it is possible to reduce the size of the gap by making the horizontal space for the appliance exactly the right size, this approach runs the risk that the horizontal space for the appliance will be too small.

For the aforementioned reasons, a gap having both horizontal and vertical components will generally be found between adjacent appliances or appliance modules. This gap is undesirable for a number of reasons. When cleaning the appliances, appliance modules, or surrounding cabinetry using a cloth or sponge, liquids, grease, food, or other debris may fall into the gap and collect therein. It is typically difficult or even impossible to clean the debris that collect in the gap without dismantling the appliance or moving the appliance. Over an extended period of time, the debris collecting in the gap can form a medium for the growth of mold or fungus, it can attract insects or vermin, and in some cases may even create a fire hazard. Besides the health and safety concerns raised by such a gap between appliances or appliance modules, the gap will typically present an unfinished and unattractive appearance, lowering the perceived quality of the appliances or appliance modules and causing them to appear mismatched with each other and their surroundings.

While devices are known for use in covering horizontal gaps, these prior devices do not adjust to different height misalignments between adjacent appliances, appliances modules, and/or surrounding cabinetry and countertops. Thus, there is a need for a cover plate that can be placed between adjacent surfaces to span any height misalignment that may exist between the adjacent surfaces. What is further needed is a cover plate that provides an aesthetically pleasing cover plate.

SUMMARY OF THE INVENTION

An exemplary embodiment relates to a device for spanning a gap between adjacent surfaces comprising a pin having a head and a tip; and a cover plate having a top face and first and second bottom faces adapted to be positioned adjacent to the edges of the adjacent surfaces, wherein the head of the pin is rotatably connected to the cover plate at one or more points between the first bottom face of the cover plate and the second bottom face of the cover plate.

In a preferred embodiment, the pin is a pin plate, and the pin plate and cover plate are rotatably connected by a ball and socket joint. The ball can be located on the pin plate with the socket located on the cover plate, or vice-versa. The ball is preferably connected to the pin plate or cover plate by a narrowed neck. The ball preferably has a circumference that extends at least half of an entire circle, and the socket preferably includes an opening that extends less than half of an entire circle, so that when the ball is inserted in the socket with the neck extending through the gap, the ball is captured within the socket. The ball or the socket or both can be elongated.

The pin plate may be formed of metal material, for example by extruding the material through a die. Preferably, the metal material is silicon aluminum. The pin plate may include one or more protrusions that extend from a first face of the pin plate. The protrusion may be rounded, saw toothed, etc. Although the device preferably includes a pin plate, this is not required and the cover plate may be used with one or more pins instead of or in addition to a pin plate.

The cover plate may be formed of metal material, for example by extruding the material through a die. Preferably, the metal material is silicon aluminum. The top face may be flat, concave, convex, etc. and may include one or more ridges that extend in a direction parallel to an elongated edge of the cover plate.

Either bottom face of the cover plate may include a notch that extends in a direction parallel to an elongated edge of the cover plate. The notch can be used, for example, to couple with an edge or protrusion of at least one of the adjacent surfaces thereby fixing the cover plate in place over the gap. Alternatively, the notch may include a protrusion extending from the interior surface of the notch. For example, the protrusion can be capable of coupling with an indentation in at least one of the adjacent surfaces thereby fixing the cover plate in place over the gap.

Another exemplary embodiment of the invention relates to a method of installing an appliance having a lateral edge adjacent to a surface having a lateral edge, where the edges of the appliance and surface are separated by a gap. The method includes providing a cover plate and a pin which are rotatably coupled together, inserting the pin into the gap, and rotating the cover plate relative to the pin until the bottom faces of the cover plate engage the edges of the appliance and the surface to span the gap.

Other principal features and advantages of the invention will become apparent to those skilled in the art upon review of the following drawings, the detailed description, and the appended claims.

BRIEF DESCRIPTION OF THE DRAWINGS

The exemplary embodiments will hereafter be described with reference to the accompanying drawings, wherein like numerals will denote like elements.

DETAILED DESCRIPTION OF THE PREFERRED EMBODIMENTS

Figure 1:
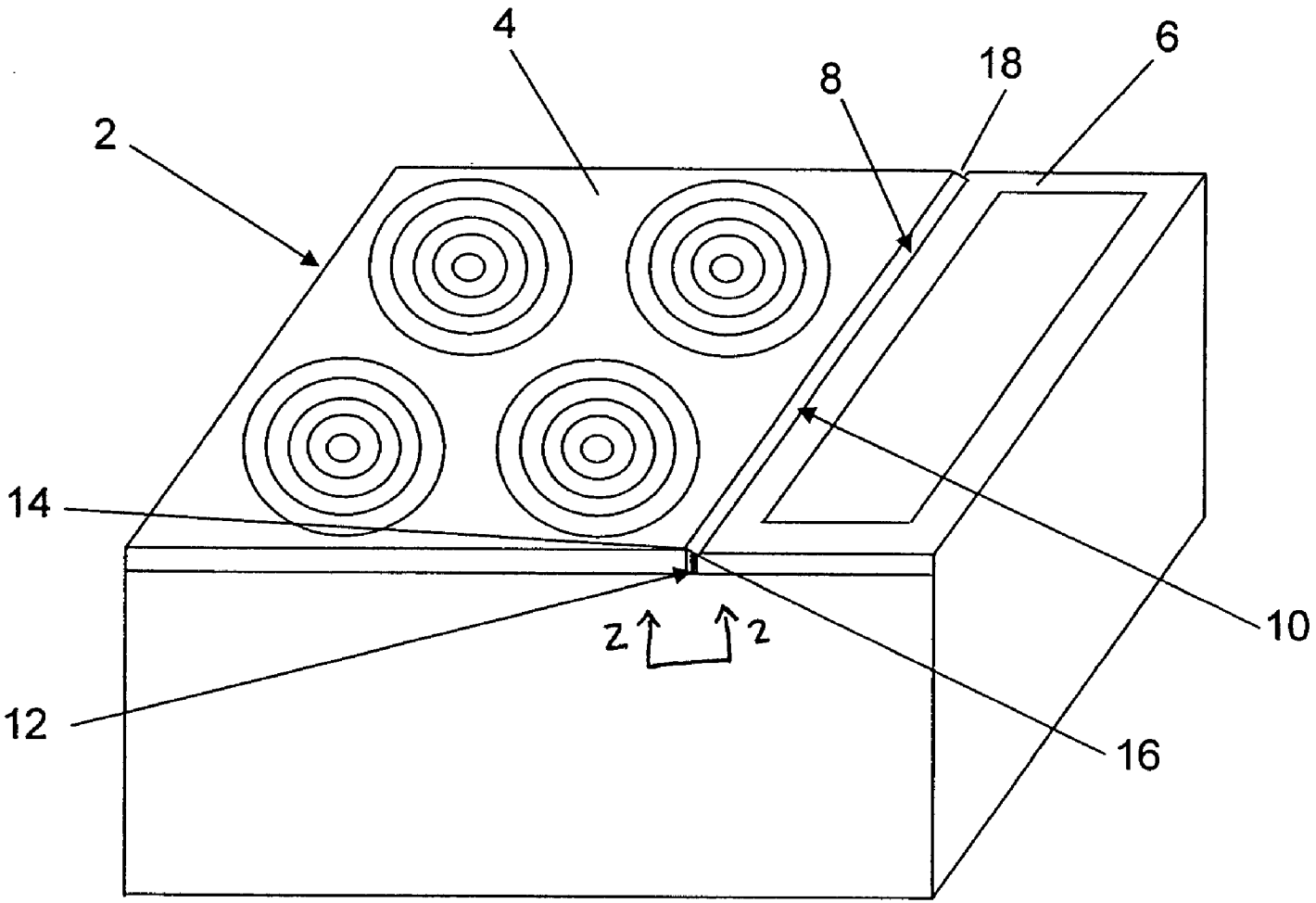
FIG. 1 is a perspective view of an appliance including a rotatable cover plate assembly in accordance with a preferred embodiment of the invention.

With reference to FIG. 1, an appliance is shown generally at 2. The appliance includes a first surface 4. For exemplification, the first surface 4 may comprise a stove. A second surface 6 is adjacent a first edge 14 of the first surface 4. For exemplification, the second surface 6 may comprise a griddle. In an alternative embodiment, the second surface 6 may comprise a countertop. The first surface 4 and the second surface 6 may not align seamless, both vertically and horizontally, so generally a gap 18 will be found between the first edge 14 of the first surface 4 and a first edge 16 of the second surface 6.

FIG. 1 shows a preferred embodiment of a rotatable cover plate assembly 8 according to the invention, which includes a cover plate 10 and a pin plate 12, which are rotatably coupled together. The rotatable cover plate assembly 8 can be used, for example, to span the gap 18 between the first edge 14 of the first surface 4 and the first edge 16 of the second surface 6.

A rotatable cover plate assembly according to the invention may be incorporated into an appliance 2 formed of multiple appliance modules, for example as shown in FIG. 1. The rotatable cover plate assembly, however, may be used to span any gap that exists between adjacent surfaces. Such additional adjacent surfaces include, but are not limited to, an appliance adjacent to a countertop, two tables, two countertops, etc.

Although the first surface 4 and the second surface 6 in FIG. 1 are shown as being essentially flat and having a generally rectangular shape, this is not required. The first surface 4 and the second surface 6 may take the form of various other geometrical shapes, e.g., square, polygon, triangle, circle, ellipse, etc. The rotatable cover plate assembly 8 can be modified to follow either of the first edge 14 of the first surface 4 and/or the first edge 16 of the second surface 6.

Figure 2:
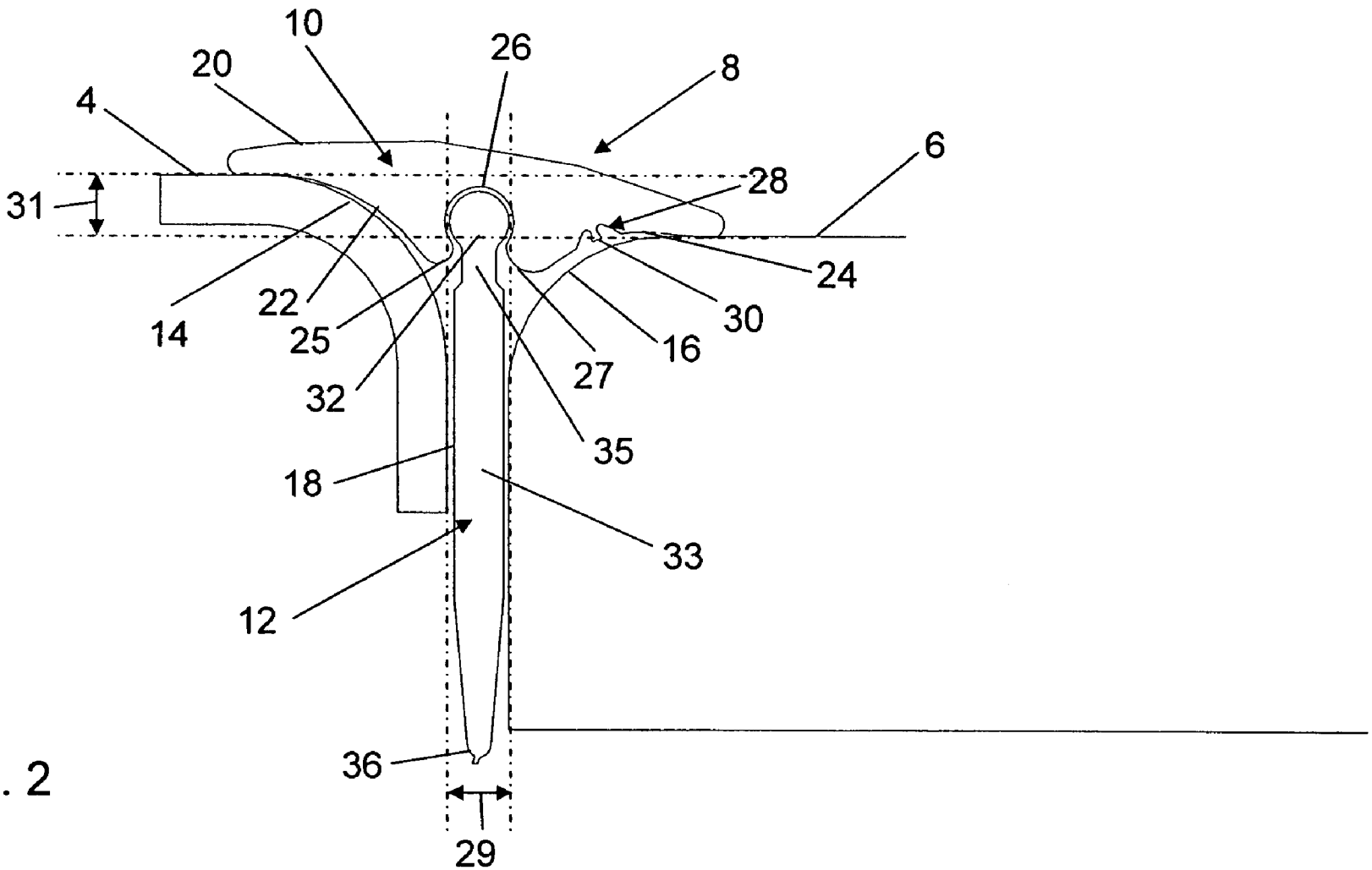
FIG. 2 is a cross sectional view of the rotatable cover plate assembly and adjacent portions of the appliance of FIG. 1 taken along the line 2—2 thereof.

FIG. 2 is a cross sectional view of the rotatable cover plate assembly and adjacent portions of the appliance of FIG. 1 taken along the line 2—2 thereof. The rotatable cover plate assembly 8 bridges the gap 18 between the first edge 14 of the first surface 4 and the first edge 16 of the second surface 6. In the preferred embodiment of FIG. 2, the rotatable cover plate assembly 8 includes a cover plate 10 and a pin plate 12 which are rotatably coupled together, for example by a ball and socket joint or other hinge assembly known in the art.

The cover plate 10 preferably includes a top face 20, a first bottom face 22, a second bottom face 24, a socket 26, and a notch 28. The top face 20 faces up opposite the gap 18 and is ordinarily exposed. The top face 20 may have a generally convex shape as shown in FIG. 2 although is not required, and other shapes could be used, such as concave, ribbed, and flat. The cover plate 10 is preferably sized to cover the maximum width 29 of the gap 18 which is expected, with a suitable amount of overlap between the cover plate 10 and the adjacent surfaces 4, 6.

The cover plate 10 includes a first bottom face 22 and a second bottom face 24 which face generally down towards the gap 18. The first bottom face 22 and the second bottom face 24 are preferably shaped to conform to the shape of the first edge 14 of the first surface 4 and the first edge 16 of the second surface 6 respectively. For example, when the edges of the adjacent surfaces are convex, the first bottom face 22 and the second bottom face 24 preferably have a generally concave shape as shown in FIG. 2 although this is not required and other shapes, such as indented, convex, ribbed, or flat, could be used. Although the rotatable cover plate assembly 10 includes a first bottom face 22 and a second bottom face 24 having similar general shapes, this is not required, and the two bottom faces may have different shapes.

The first bottom face 22 and the second bottom face 24 are located on either side of a socket 26. The first bottom face 22 includes an edge 25 adjacent to one side of the socket 26, and the second bottom face 24 includes an edge 27 adjacent the opposing side of the socket 26. In the rotatable cover plate assembly 10, the socket 26 has a concave shape adapted to rotatably couple with a convex ball 32 of the pin plate 12. However, this is not required and the rotatable coupling can be accomplished in other ways, for example using a convex ball on a cover plate to rotatably couple with a concave socket on a pin plate. The rotatable coupling is preferably adapted to allow the cover plate 10 to rotate relative to the pin plate 12 enough to cover the maximum height difference 31 which is expected.

The cover plate 10 preferably includes a notch 28 which is adapted to engage a corner or protrusion in an edge of an adjacent surface, for example a corner (not shown) on the first edge 16 of the second surface 6, to seat the cover plate 10 in place over the gap 18.

The notch 28 may also include a protrusion 30 extending from the interior surface of the notch 28, although this is not required. The protrusion 30, if present, is preferably adapted to engage an indentation or slot in an edge of an adjacent surface, for example a slot (not shown) on the first edge 16 of the second surface 6, to seat the cover plate 10 in place over the gap 18. Although the preferred embodiment of FIG. 2 shows the protrusion 30 located within a notch 28, this is not required and a protrusion 30 can be placed between two notches 28 or directly on either bottom face of the cover plate 10 outside of any notch 28.

It can be seen that a variety of other notch and protrusion configurations could be used to seat the cover plate 10 in place over the gap 18. For example, a notch 28, or a plurality of notches 28, may be located on either or both bottom faces 22, 24 with or without a protrusion 30. Alternatively, neither of the first bottom face 22 or the second bottom face 24 may have a notch. Similarly, a protrusion 30, or a plurality of protrusions 30, can be located on either or both bottom faces 22, 24 with or without one or more notches 28. In an appropriate case, a rotatable cover plate can be used without any notch or protrusion for seating. The placement and configuration of the notch 28 and/or the protrusion 30 are preferably chosen to engage with at least one of the edges 14, 16, so the notch 28 and/or the protrusion 30 may have a different location, size, and shape depending on the characteristics of either or both of the edges 14, 16.

The pin or pin plate 12 preferably includes a ball 32, a plate 33, and a neck 35 between the ball 32 and the plate 33. The ball 32 is disposed at one elongated edge of the pin plate 12 and is preferably adapted to rotatably couple with the socket 26 of the cover plate 10. The ball 32 may be circular or ellipsoidal in shape. The plate 33 may be provided in a variety of widths, allowing the pin plate 12 to fit within gaps 18 having a variety of widths.

The neck 35 is disposed between the plate 33 and the ball 32 and is preferably narrower in width than the plate 33, to allow a greater degree of rotation of the pin plate 12 relative to the cover plate 10. However, the neck 35 is not necessary, and the ball 32 may be disposed directly on the plate 33. Alternatively, the neck 35 may be wider than the plate 33 if it is desired to limit the degree of rotation of the pin plate 12 relative to the cover plate 10.

The socket 26 and the ball 32 form a ball and socket joint that allows rotation of the cover plate 10 relative to the pin plate 12. By allowing rotation of the pin plate 12 relative to the cover plate 10, the rotatable cover plate 8 is capable of spanning both the width 29 of the gap 18 and the height difference 31 between the first surface 4 and the second surface 6. Prior art cover plates having a unitary construction do not provide for this rotation of the pin plate 12 relative to the cover plate 10. As a result, these prior art cover plates to not adequately engage with the adjacent edges of the adjacent surfaces, so that there is generally a gap under one side or the other of these prior art unitary cover plates.

Figure 3:
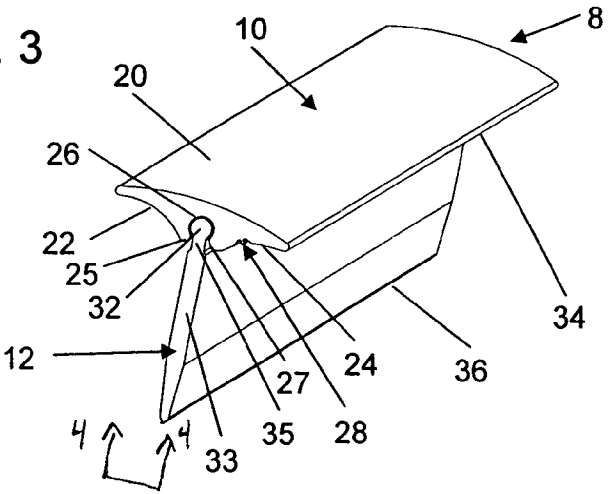
FIG. 3 is a perspective view of the rotatable cover plate assembly of FIG. 2.

FIG. 3 is a perspective view of the rotatable cover plate assembly of FIG. 2. The ball 32 is disposed on a first elongated edge of the plate 33 opposite a second elongated edge 36. The socket 26 is disposed on the bottom face of the cover plate 10 and extends in a direction parallel to an elongated edge 34 of the cover plate 10. The ball 32 is an exemplary head of pin plate 12. The second elongated edge 36 is an exemplary tip of pin plate 12.

Figure 4:
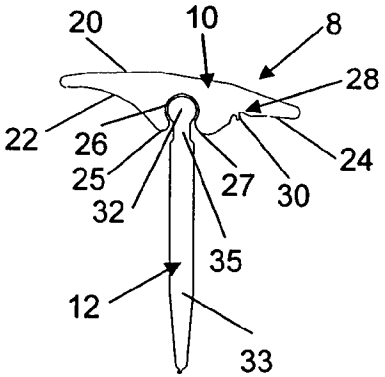
FIG. 4 is a cross sectional view of the rotatable cover plate assembly of FIG. 3 taken along the line 4—4 thereof.

FIG. 4 is a cross sectional view of the rotatable cover plate assembly of FIG. 3 taken along the line 4—4 thereof. The pin plate 12 may rotate relative to the cover plate 10 until the neck 35 contacts the first or second edge 25, 27 of the first or second bottom face 22, 24 of the cover plate 10. The amount of rotation needed in a particular application depends on the relative heights of the adjacent surfaces 4, 6. For example, in FIG. 5 the pin plate is rotated to the left through an angle 38, as would be the case if the right side adjacent surface is slightly higher than the left side adjacent surface. Similarly, in FIG. 6 the pin plate is rotated to the right through an angle 39, as would be the case if the left side adjacent surface is slightly higher than the right side adjacent surface.

Figure 6:
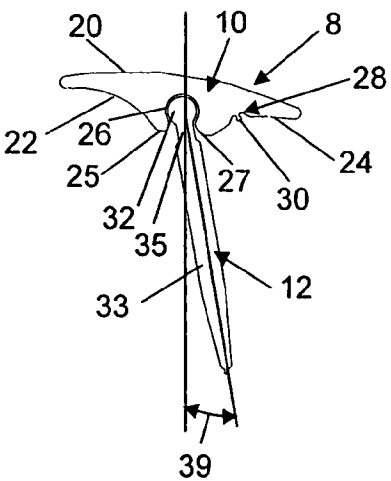
FIG. 6 is a cross sectional view of the rotatable cover plate assembly of FIG. 4, with the pin plate rotated to the right.
Figure 5:
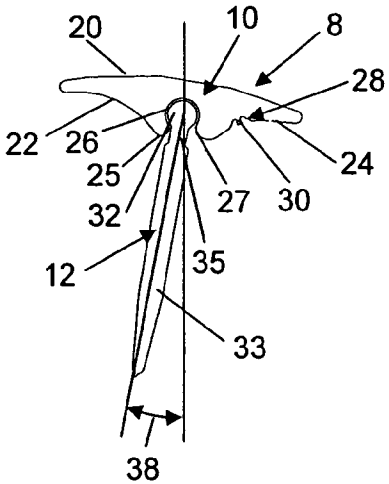
FIG. 5 is a cross sectional view of the rotatable cover plate assembly of FIG. 4, with the pin plate rotated to the left.

The maximum height difference which can be bridged by the rotatable cover plate assembly depends on the maximum left and right rotation of the pin plate relative to the cover plate. As shown in FIG. 5, the pin plate 12 may rotate through an angle 38 relative to the cover plate 10 until the neck 35 contacts the first bottom face 22 at the edge 25, which imposes the leftward rotation limit. Similarly, as shown in FIG. 6, the pin plate 12 may rotate through an angle 39 relative to the cover plate 10 until the neck 35 contacts the second bottom face 24 at the edge 27, which imposes the rightward rotation limit. The left and right rotation limits may or may not be equal depending upon the shape of the neck 35 and the shape of the edge 25 of the first bottom face 22 and of the edge 27 of the second bottom face 24.

Figure 7:
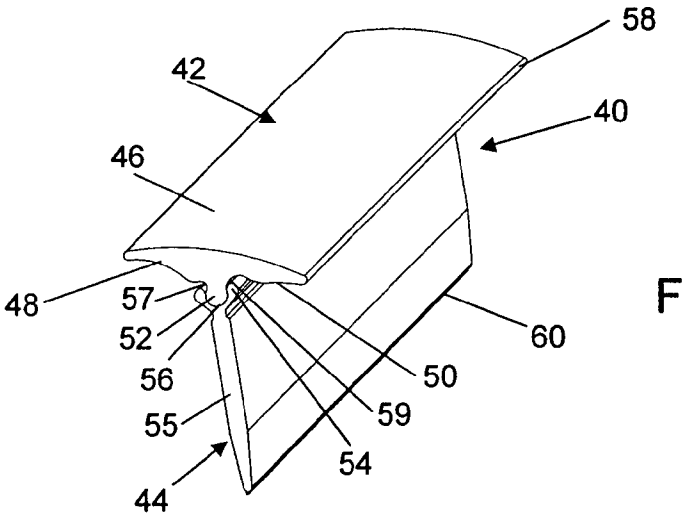
FIG. 7 is a perspective view of a rotatable cover plate assembly in accordance with an alternative embodiment of the invention.
Figure 9:
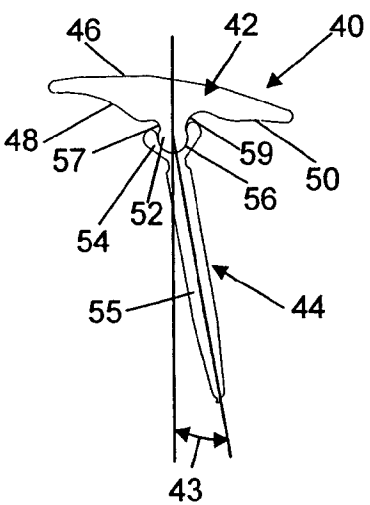
FIG. 9 is a cross sectional view of the rotatable cover plate assembly of FIG. 7, with the pin plate rotated to the right.
Figure 8:
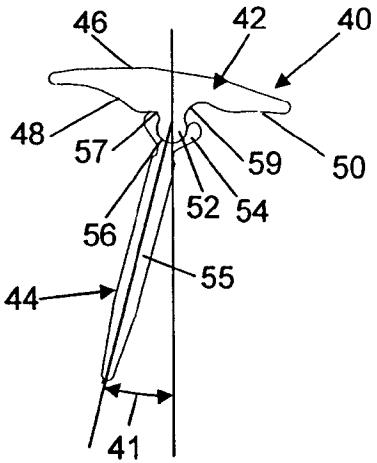
FIG. 8 is a cross sectional view of the rotatable cover plate assembly of FIG. 7, with the pin plate rotated to the left.

FIG. 7 shows a perspective view of an alternative embodiment of a rotatable cover plate assembly 40 according to the invention. Like the rotatable cover plate assembly 8 of FIGS. 1–6, the rotatable cover plate assembly 40 includes a cover plate rotatably coupled to a pin plate. However, where the rotatable cover plate assembly 8 includes a pin plate with a ball that rotatably engages a socket on a cover plate, the rotatable cover plate assembly 40 of FIGS. 7–9 includes a pin plate with a socket that rotatably engages a ball on a cover plate. While the positions of the ball and socket are interchanged, the other features of the rotatable cover plate assembly 8, such as the notch and protrusions used for seating, could be used on the rotatable cover assembly 40.

The rotatable cover plate assembly 40 of FIG. 7 includes a cover plate 42 and a pin plate 44. The cover plate 42 includes a top face 46, a first bottom face 48, a second bottom face 50, and a ball 52. The ball 52 preferably has a convex shape, and is disposed between a first edge 57 of the first bottom face 48 and a first edge 59 of the second bottom face 50. The ball 52 preferably extends in a direction generally parallel to an elongated edge 58 of the cover plate 42.

The pin plate 44 preferably includes a socket 54 and a plate 55. The socket 54 is disposed on an elongated edge of the plate 55 opposite an elongated edge 60 of the plate 55. The socket 54 preferably has a concave surface 56 that rotatably engages with the ball 52 of the cover plate 42. The socket 54 is an exemplary head of pin plate 44. The elongated edge 60 is an exemplary tip of pin plate 12.

The pin plate 44 may rotate relative to the cover plate 42 until the socket 54 contacts the first or second bottom face 48, 50 of the cover plate 46 at a respective edge 57, 59. The amount of rotation needed in a particular application depends on the relative heights of the adjacent surfaces bridged by the rotatable cover plate assembly. For example, in FIG. 8 the pin plate is rotated to the left through an angle 41, as would be the case if the right side adjacent surface is slightly higher than the left side adjacent surface. Similarly, in FIG. 9 the pin plate is rotated to the right through an angle 43, as would be the case if the left side adjacent surface is slightly higher than the right side adjacent surface. The left and right rotation limits may or may not be equal depending upon the shape of the socket 54 and the shapes of the first bottom face 48 and the second bottom face 50.

Figure 10:
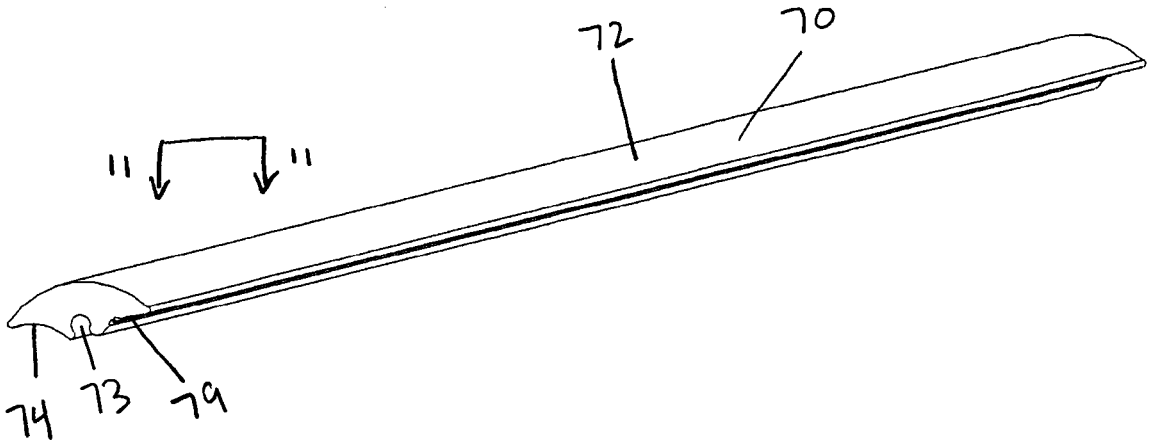
FIG. 10 is a perspective view of an alternative cover plate for use in a rotatable cover plate assembly according to the invention.
Figure 11:
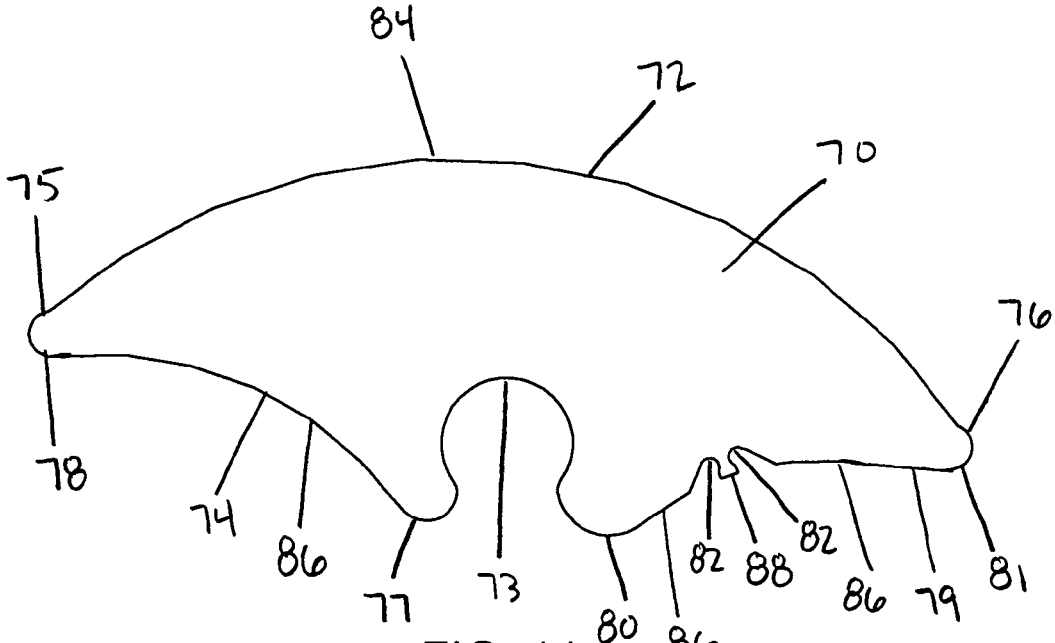
FIG. 11 is a cross sectional view of the cover plate of FIG. 10 taken along the line 11—11 thereof.

FIG. 10 is a perspective view of an alternative cover plate 70 for use in a rotatable cover plate assembly according to the invention. FIG. 11 is a cross sectional view of the cover plate 70 of FIG. 10 taken along the line 11—11 thereof. The cover plate 70 can be used with any suitable pin plate that includes a ball to rotatably couple with the socket 73 on the cover plate 70. For example, the pin plate 12 of FIGS. 1–6, the pin plate 130 of FIGS. 16–17, or the pin plate 140 of FIGS. 18–19, or any similar pin plate that includes a suitable ball could be used with the cover plate 70 to form a rotatable cover plate according to the invention. It can be seen that the cover plate 70 could be adapted to include a ball instead of a socket, so that the adapted cover plate could be used with a pin plate that includes a socket, such as the pin plate 44 of FIGS. 7–9.

The cover plate 70 includes a top face 72, which is ordinarily exposed when the rotatable cover plate assembly is installed, and a socket 73 positioned between a first bottom face 74 and a second bottom face 79. The top face 72 extends from a first edge 75 to a second edge 76. The first bottom face 74 extends between an inside edge 77 and an outside edge 78. The second bottom face 79 extends between an inside edge 80 and an outside edge 81.

The top face 72 preferably includes a convex portion 84, although this is not required and other shapes may be used. The first bottom face 74, or the second bottom face 79, or both, may include one or more notches 82, although this is not required. The first bottom face 74, or the second bottom face 79, or both, may include one or more concave portions 86, although this is not required. The first bottom face 74, or the second bottom face 79, or both, may include one or more protrusions 88, which may be located within a notch 82, between two notches 82, or outside any notch 82, although this is not required. The placement and configuration of the one or more notches 82 and/or the one or more protrusions 88 are preferably chosen to engage with at least one of the adjacent edges surrounding the gap which is to be bridged by the cover plate 70.

Figure 12:
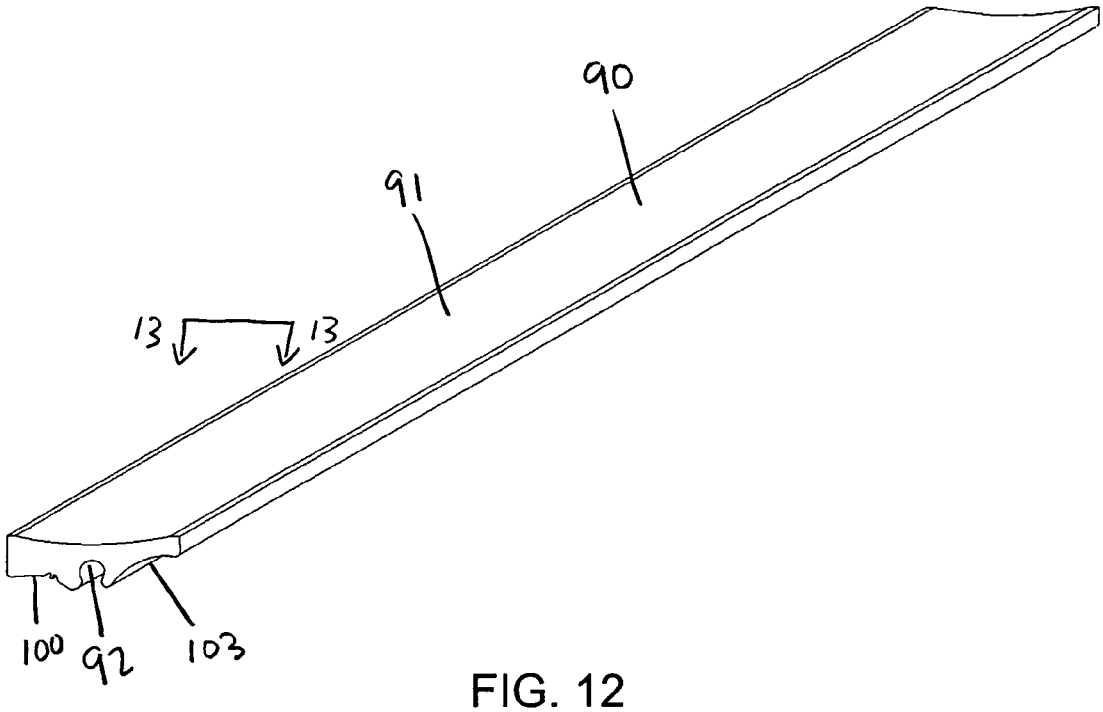
FIG. 12 is a perspective view of another cover plate for use in a rotatable cover plate assembly according to the invention.
Figure 13:
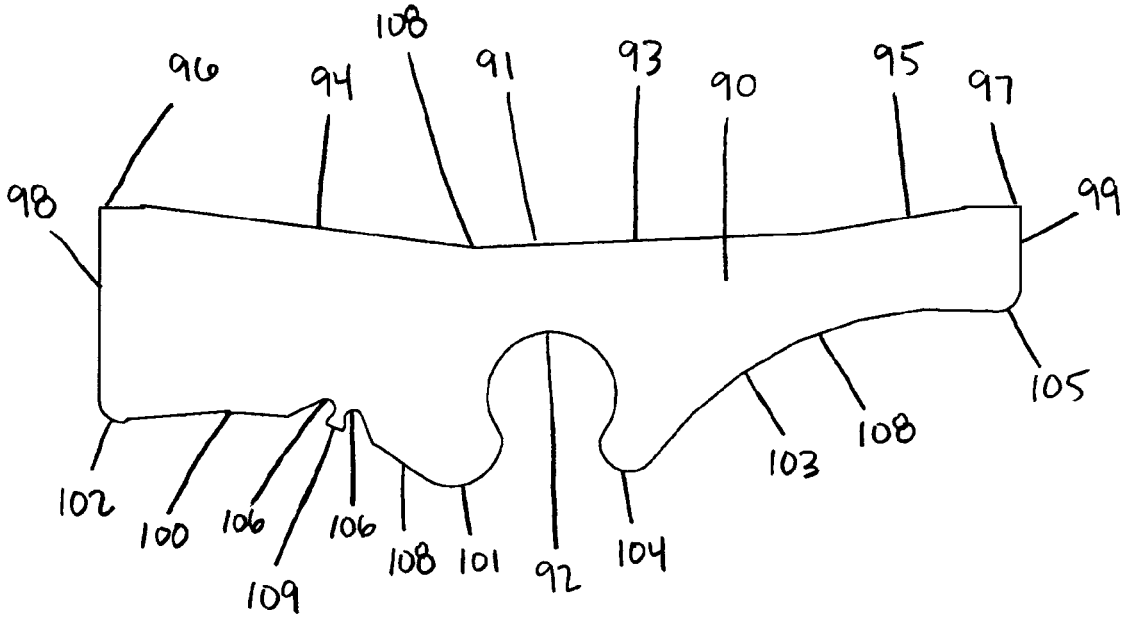
FIG. 13 is a cross sectional view of the cover plate of FIG. 12 taken along the line 13—13 thereof.

FIG. 12 is a perspective view of an another cover plate 90 for use in a rotatable cover plate assembly according to the invention. FIG. 13 is a cross sectional view of the cover plate 90 of FIG. 12 taken along the line 13—13 thereof. The cover plate 90 can be used with any suitable pin plate that includes a ball to rotatably couple with the socket 92 on the cover plate 90. For example, the pin plate 12 of FIGS. 1–6, the pin plate 130 of FIGS. 16–17, or the pin plate 140 of FIGS. 18–19, or any similar pin plate that includes a suitable ball could be used with the cover plate 90 to form a rotatable cover plate according to the invention. It can be seen that the cover plate 90 could be adapted to include a ball instead of a socket, so that the adapted cover plate could be used with a pin plate that includes a socket, such as the pin plate 44 of FIGS. 7–9.

The cover plate 90 includes a top face 91, which is ordinarily exposed when the rotatable cover plate assembly is installed. The top face 91 preferably includes a relatively flat or concave central portion 93 surrounded by a first side portion 94 that slopes up to a first edge 96 and a second side portion 95 that slopes up to a second edge 97.

The cover plate 90 includes a socket 92 positioned between a first bottom face 100 and a second bottom face 103. The first bottom face 100 extends from an inside edge 101 to an outside edge 102. The second bottom face 103 extends from an inside edge 104 to an outside edge 105.

The slope of the first side portion 94 is preferably greater than the slope of the second side portion 95, so that the cover plate 90 is somewhat thicker on the first side than on the second side, although this is not required. For example, the cover plate 90 can include a thick side face 98 that extends from the first edge 96 of the top face to the outside edge 102 of the first bottom face 100, and a thin side face 99 that extends from the second edge 97 of the top face to the outside edge 105 of the second bottom face 103.

The first bottom face 100, or the second bottom face 103, or both, may include one or more notches 106, although this is not required. The first bottom face 100, or the second bottom face 103, or both, may include one or more concave portions 108, although this is not required. The first bottom face 100, or the second bottom face 103, or both, may include one or more protrusions 109, which may be located within a notch 106, between notches 106, or outside any notch 106, although this is not required. If used, the placement and configuration of the one or more notches 106 and/or the one or more protrusions 109 are preferably chosen to engage with at least one of the adjacent edges surrounding the gap which is to be bridged by the cover plate 90.

Figure 14:
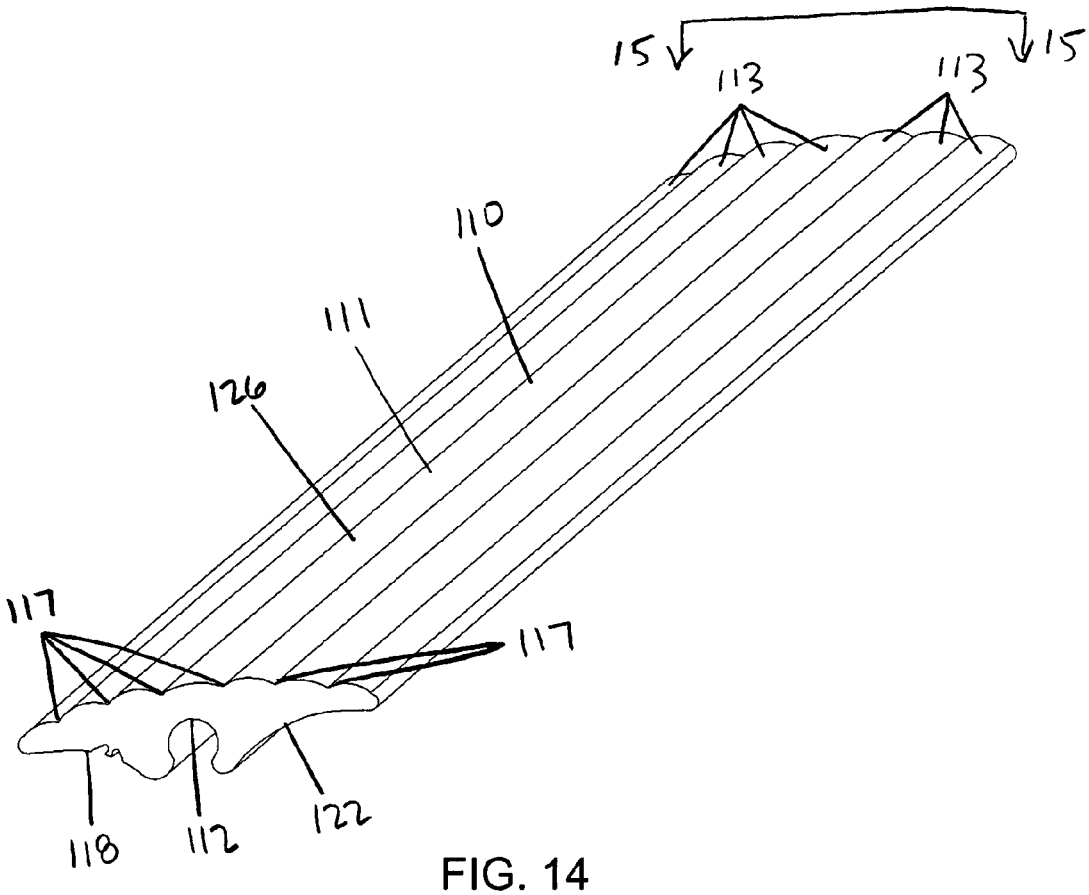
FIG. 14 is a perspective view of another alternative cover plate for use in a rotatable cover plate assembly according to the invention.
Figure 15:
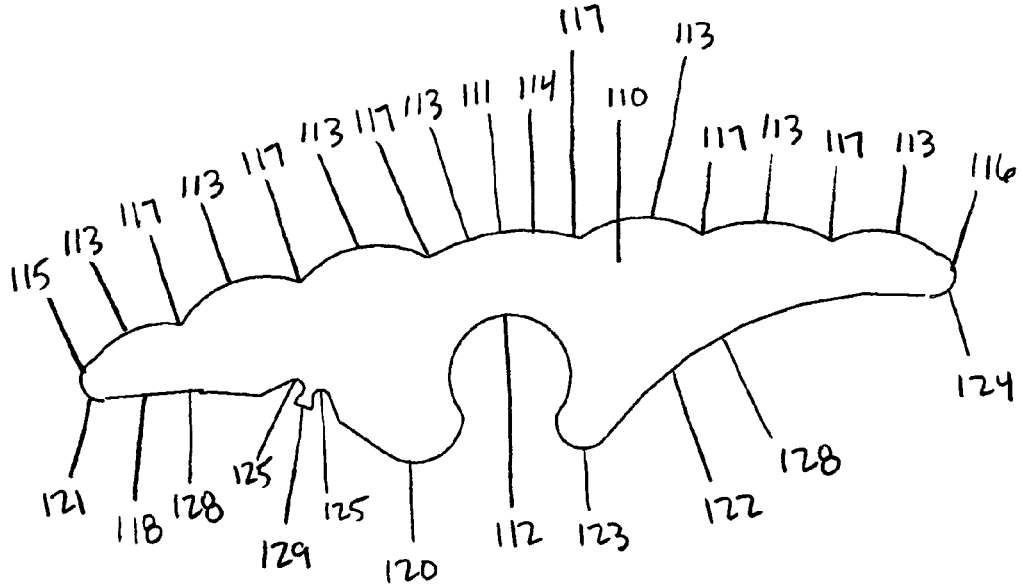
FIG. 15 is a cross sectional view of the cover plate of FIG. 14 taken along the line 15—15 thereof.

FIG. 14 is a perspective view of an another cover plate 110 for use in a rotatable cover plate assembly according to the invention. FIG. 15 is a cross sectional view of the cover plate 110 of FIG. 14 taken along the line 15—15 thereof. The cover plate 110 can be used with any suitable pin plate that includes a ball to rotatably couple with the socket 112 on the cover plate 110. For example, the pin plate 12 of FIGS. 1–6, the pin plate 130 of FIGS. 16–17, or the pin plate 140 of FIGS. 18–19, or any similar pin plate that includes a suitable ball could be used with the cover plate 110 to form a rotatable cover plate according to the invention. It can be seen that the cover plate 110 could be adapted to include a ball instead of a socket, so that the adapted cover plate could be used with a pin plate that includes a socket, such as the pin plate 44 of FIGS. 7–9.

The cover plate 110 includes a top face 111, which is ordinarily exposed when the rotatable cover plate assembly is installed, extending from a first edge 115 to a second edge 116. Although not required, the top face 111 preferably includes seven longitudinal ribs 113 separated by longitudinal notches 117, including a central rib 114. The ribs 113 may be used to improve the aesthetic appearance of the top face 111. Although the ribs 113 are preferably generally convex, this is not required and other shapes or designs may be used. Other shapes or designs may be incorporated into the top face 111 to further improve the aesthetic appearance of the cover plate 110 without deviating from the spirit of the invention, with or without the use of longitudinal ribs 113. A greater or lesser number of longitudinal ribs could be used. The general shape of the top face 111 is preferably generally convex, although this is not required.

The cover plate 110 includes a socket 112 positioned between a first bottom face 118 and a second bottom face 122. The first bottom face 118 extends from an inside edge 120 to an outside edge 121. The second bottom face 122 extends from an inside edge 123 to an outside edge 124.

The first bottom face 118, or the second bottom face 122, or both, may include one or more notches 125, although this is not required. The first bottom face 118, or the second bottom face 122, or both, may include one or more concave portions 108, although this is not required. The first bottom face 118, or the second bottom face 122, or both, may include one or more protrusions 129, which may be located within a notch 125, between notches 125, or outside a notch 125, although this is not required. If used, the placement and configuration of the one or more notches 125 and/or the one or more protrusions 129 are preferably chosen to engage with at least one of the adjacent edges surrounding the gap which is to be bridged by the cover plate 90.

Figure 16:
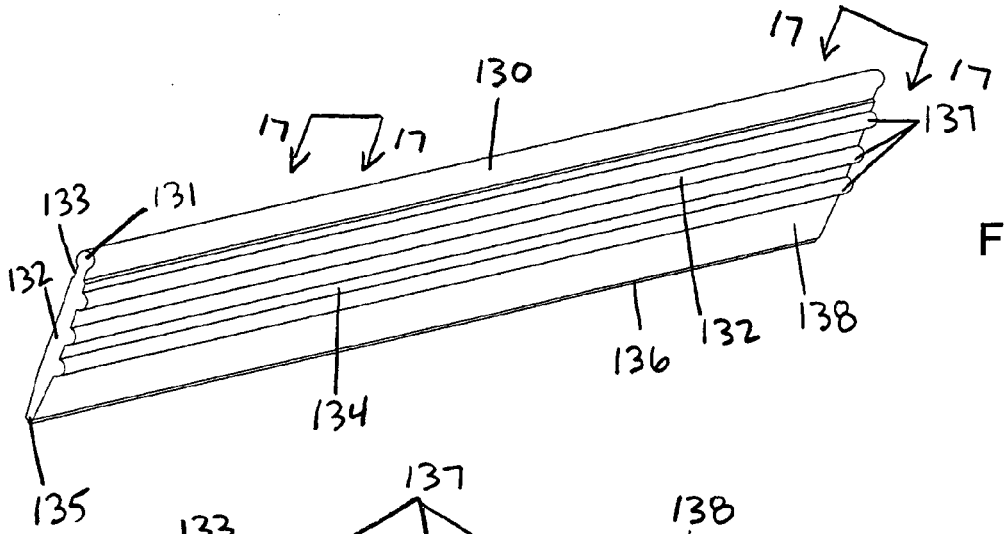
FIG. 16 is a perspective view of an alternative pin plate for use in a rotatable cover plate assembly according to the invention.
Figure 17:
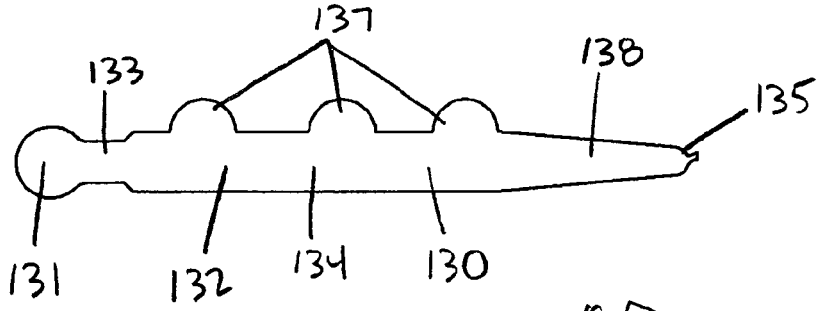
FIG. 17 is a cross sectional view of the pin plate of FIG. 16 taken along the line 17—17 thereof.

FIG. 16 is a perspective view of an alternative pin plate 130 for use in a rotatable cover plate assembly according to the invention. FIG. 17 is a cross sectional view of the pin plate 130 of FIG. 16 taken along the line 17—17 thereof. The pin plate 130 can be used with any suitable cover plate that includes a socket to rotatably couple with the ball 131 on the pin plate 130. For example, the cover plate 10 of FIGS. 1–6, the cover plate 70 of FIGS. 10–11, the cover plate 90 of FIGS. 12–13, or the cover plate 110 of FIGS. 14–15, or any similar cover plate that includes a suitable socket could be used with the pin plate 130 to form a rotatable cover plate according to the invention. It can be seen that the pin plate 130 could be adapted to include a socket instead of a ball, so that the adapted pin plate could be used with a cover plate that includes a ball, such as the cover plate 42 of FIGS. 7–9.

The pin plate 130 includes a ball 131 and a plate 132, connected by a neck 133. The neck 133 is preferably narrower than the plate 132, but this is not required. There may not be a neck 133. The plate 132 includes a pin plate central portion 134, and terminates in a pin plate tip 135. The portion of the plate 132 between the central portion 134 and the tip 135 is preferably tapered, although this is not required. The pin plate 130 has an elongated edge 136. The ball 131 is an exemplary head of pin plate 130.

The pin plate 130 preferably includes one or more protrusions 137 extending longitudinally parallel to the elongated edge 136, although this is not required. The protrusions 137 can be used, for example, to seat the pin plate 130 in a gap. Although the pin plate 130 includes three protrusions, all on one side of the pin plate and all having the same size, it can be seen that a greater or lesser number of protrusions can be used, and that protrusions can be provided on both sides of the pin plate. A selection of pin plates having protrusions in a variety of sizes can also be provided, forming a kit which can be used to cover gaps of a variety of sizes.

Figure 18:
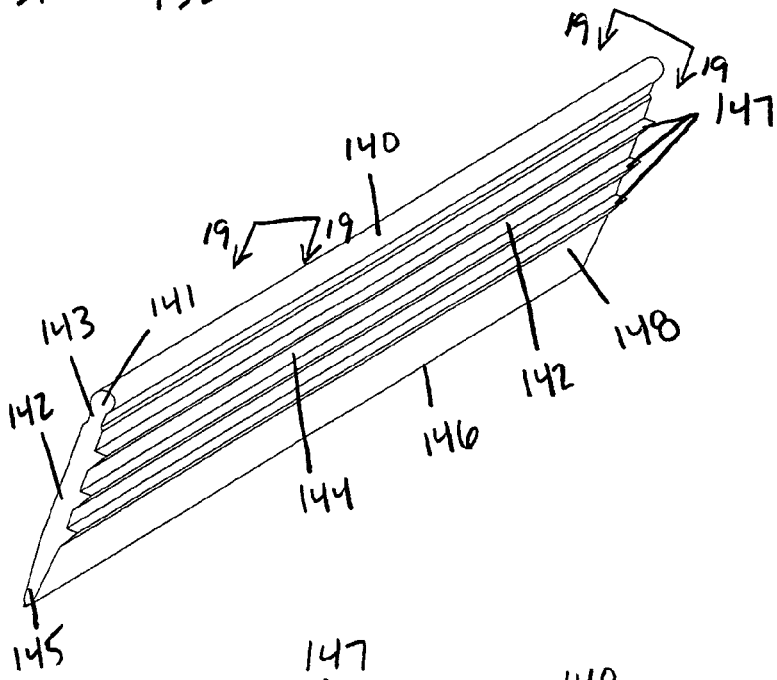
FIG. 18 is a perspective view of another pin plate for use in a rotatable cover plate assembly according to the invention.
Figure 19:
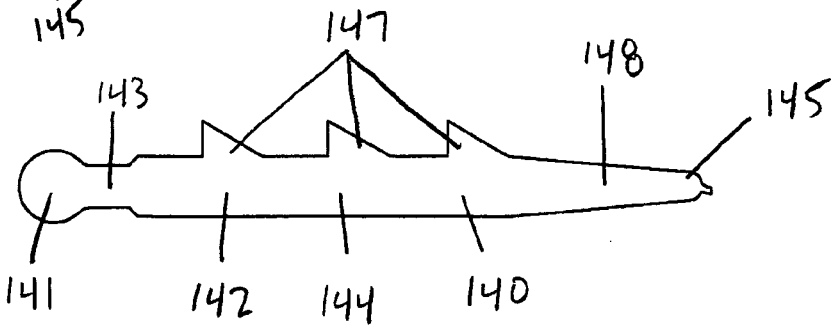
FIG. 19 is a cross sectional view of the cover plate of FIG. 18 taken along the line 19—19 thereof.

FIG. 18 is a perspective view of another alternative pin plate 140 for use in a rotatable cover plate assembly according to the invention. FIG. 19 is a cross sectional view of the pin plate 140 of FIG. 18 taken along the line 19—19 thereof. The pin plate 140 can be used with any suitable cover plate that includes a socket to rotatably couple with the ball 141 on the pin plate 140. For example, the cover plate 10 of FIGS. 1–6, the cover plate 70 of FIGS. 10–11, the cover plate 90 of FIGS. 12–13, or the cover plate 110 of FIGS. 14–15, or any similar cover plate that includes a suitable socket could be used with the pin plate 140 to form a rotatable cover plate according to the invention. It can be seen that the pin plate 140 could be adapted to include a socket instead of a ball, so that the adapted pin plate could be used with a cover plate that includes a ball, such as the cover plate 42 of FIGS. 7–9.

The pin plate 140 includes a ball 141 and a plate 142, connected by a neck 143. The neck 143 is preferably narrower than the plate 142, but this is not required. There may not be a neck 143. The plate 142 includes a pin plate central portion 144, and terminates in a pin plate tip 145. The portion of the plate 142 between the central portion 144 and the tip 145 is preferably tapered, although this is not required. The pin plate 140 has an elongated edge 146. The ball 141 is an exemplary head of pin plate 140.

The pin plate 140 preferably includes one or more saw-tooth barbs 147 extending longitudinally parallel to the elongated edge 146, although this is not required. The barbs 147 can be used, for example, to seat the pin plate 140 in a gap. Although the pin plate 140 includes three barbs, all on one side of the pin plate and all having the same size, it can be seen that a greater or lesser number of barbs can be used, and that barbs can be provided on both sides of the pin plate. A selection of pin plates having barbs in a variety of sizes can also be provided, forming a kit which can be used to cover gaps of a variety of sizes.

The dimensions of the pin plate and the cover plate may be selected based on the width and height of the gap and the characteristics of the adjacent surfaces. The cover plate and the pin plate may be mixed and matched to correspond with different adjacent surface configurations.

The pin plate and the cover plate may be formed of any generally hard material including, but not limited to, plastic, metal, and the like. The pin plate and the cover plate may be formed from different materials. In a preferred embodiment, the pin plate and the cover plate are formed from the same material, preferably silicon aluminum. Either or both of the pin plate and cover plate may be powder coated with high temperature paint. The pin plate and the cover plate may be the same or different colors, preferably the same. Any color may be used. The top face of the cover plate may be multiple colors or materials to better match the adjacent surfaces aesthetically.

It is understood that the invention is not confined to the particular embodiments set forth herein as illustrative, but embraces all such modifications, combinations, and permutations as come within the scope of the following claims. Thus, the description of the exemplary embodiments is for purposes of illustration and not limitation.

What is claimed is:

1. A device for spanning a gap between a lateral edge of a first surface and a lateral edge of a second surface, comprising:

a pin having a head and a tip; and a cover plate, the cover plate having a first bottom face adapted to be positioned adjacent to the lateral edge of the first surface;

a second bottom face adapted to be positioned adjacent to the lateral edge of the second surface; and a top face generally opposite the first face and the second face;

wherein the head of the pin is rotatably connected to the cover plate at one or more points between the first bottom face of the cover plate and the second bottom face of the cover plate;

whereby the first bottom face of the cover plate covers the lateral edge of the first surface and the second bottom face of the cover plate covers the lateral edge of the second surface when the tip of the pin is inserted into the gap, thereby covering and spanning the gap.

2. The device of claim 1, wherein the head of the pin is rotatably connected to the cover plate by a ball and socket joint comprising a socket connected to at least one point on a line between the first face of the cover plate and the second face of the cover plate; and a ball connected to the head of the pin, wherein the ball is adapted to rotatably couple with the socket;

whereby the ball may be coupled with the socket while permitting rotation of the cover plate relative to the pin.

3. The device of claim 2, wherein the ball is integrally formed with the pin.

4. The device of claim 2, wherein the socket is integrally formed with the cover plate.

5. The device of claim 2, wherein the pin includes a neck connecting at least a portion of the ball to at least a portion of the pin, and wherein the neck is narrower than the ball.

6. The device of claim 5, wherein the ball has a circumference that extends no less than half of a complete circle, and wherein the socket has an opening that extends no more than half of a complete circle, whereby the ball may be inserted into the socket with the neck of the pin plate extending through the opening of the socket of the cover plate to join the pin plate to the cover plate while permitting rotation of the cover plate relative to the pin.

7. The device of claim 1, wherein the cover plate is formed by extrusion.

8. The device of claim 1, wherein the head of the pin is rotatably connected to the cover plate by a ball and socket joint comprising a ball connected to at least one point on a line between the first face of the cover plate and the second face of the cover plate; and a socket connected to the head of the pin, wherein the socket is adapted to rotatably couple with the ball;

whereby the socket may be coupled with the ball while permitting rotation of the cover plate relative to the pin.

9. The device of claim 8, wherein the socket is integrally formed with the pin.

10. The device of claim 8, wherein the ball is integrally formed with the cover plate.

11. The device of claim 10, wherein the cover plate is formed by extrusion.

12. The device of claim 8, wherein the cover plate includes a neck connecting at least a portion of the ball to at least one point on the line between the first face of the cover plate and the second face of the cover plate, and wherein the neck is narrower than the ball.

13. The device of claim 12, wherein the ball has a circumference that extends no less than half of a complete circle, and wherein the socket has an opening that extends no more than half of a complete circle, whereby the ball may be inserted into the socket with the neck of the cover plate extending through the opening of the socket of the pin to join the pin to the cover plate while permitting rotation of the cover plate relative to the pin.

14. The device of claim 1, wherein the pin is a pin plate, and wherein the head of the pin is a head edge of the pin plate, and wherein the head edge of the pin plate is rotatably connected to the cover plate by a ball and socket joint comprising an elongate socket forming at least a portion of a cylindrical slot having an opening, wherein the elongate socket is connected to at least a portion of a line between the first face of the cover plate and the second face of the cover plate; and an elongate ball forming at least a portion of a cylinder, wherein the elongate ball is connected to at least a portion of the head edge of the pin plate, wherein the elongate ball is adapted to rotatably couple with the elongate socket;

whereby the elongate socket may be coupled with the elongate ball while permitting rotation of the cover plate relative to the pin plate.

15. The device of claim 14, wherein the elongate ball is integrally formed with the pin plate.

16. The device of claim 1, wherein the pin is a pin plate, and wherein the head of the pin is a head edge of the pin plate, and wherein the head edge of the pin plate is rotatably connected to the cover plate by a ball and socket joint comprising an elongate ball forming at least a portion of a cylinder and connected to at least a portion of a line between the first face of the cover plate and the second face of the cover plate; and an elongate socket forming at least a portion of a cylindrical slot having an opening, wherein the socket is connected to at least a portion of the head edge of the pin plate, wherein the elongate socket is adapted to rotatably couple with the elongate ball;

whereby the elongate socket of the pin plate may be coupled with the elongate ball of the cover plate while permitting rotation of the cover plate relative to the pin plate.

17. The device of claim 16, wherein the elongate socket is integrally formed with the pin plate.

18. The device of claim 17, wherein the pin plate is formed by extrusion.

19. The device of claim 17, wherein the pin plate is formed by extrusion.

20. The device of claim 16, wherein the elongate ball is integrally formed with the cover plate.

21. The device of claim 20, wherein the cover plate is formed by extrusion.

22. The device of claim 20, wherein the cover plate is formed by extrusion.

23. The device of claim 16, wherein the cover plate includes a neck connecting at least a portion of the elongate ball to at least one point on the line between the first face of the cover plate and the second face of the cover plate, and wherein the neck is narrower than the elongate ball.

24. The device of claim 23, wherein the elongate ball has a circumference that extends no less than half of a complete circle, and wherein the elongate socket has an opening that extends no more than half of a complete circle, whereby the elongate ball may be inserted longitudinally into the elongate socket with the neck extending through the opening of the elongate socket to join the pin plate to the cover plate while permitting rotation of the cover plate relative to the pin plate.

25. The device of claim 23, wherein the elongate ball has a circumference that extends no less than half of a complete circle, and wherein the elongate socket has an opening that extends no more than half of a complete circle, whereby the elongate ball may be inserted longitudinally into the elongate socket with the neck extending through the opening of the elongate socket to join the pin plate to the cover plate while permitting rotation of the cover plate relative to the pin plate.

26. The device of claim 16, wherein the pin plate includes a neck connecting at least a portion of the elongate ball to at least one point on head edge of the pin plate, and wherein the neck is narrower than the elongate ball.

27. The device of claim 16, wherein the elongate socket is integrally formed with the cover plate.

28. A device for spanning a gap between a lateral edge of a first surface and a lateral edge of a second surface, comprising:

a pin having a head and a tip; and a cover plate, the cover plate having a first bottom face adapted to be positioned adjacent to the lateral edge of the first surface;

a second bottom face adapted to be positioned adjacent to the lateral edge of the second surface; and a top face generally opposite the first face and the second face;

wherein the head of the pin is connected by a ball and socket joint to the cover plate at one or more points between the first bottom face of the cover plate and the second bottom face of the cover plate;

whereby the first bottom face of the cover plate covers the lateral edge of the first surface and the second bottom face of the cover plate covers the lateral edge of the second surface when the tip of the pin is inserted into the gap, thereby covering and spanning the gap.

29. The device of claim 28, wherein the pin includes a central portion between the head and the tip, wherein the central portion includes a protrusion.

30. The device of claim 29, wherein the protrusion has a rounded shape.

31. The device of claim 29, wherein the protrusion has a saw-toothed shape.

32. The device of claim 28, wherein the top face of the cover plate is generally flat.

33. The device of claim 28, wherein the top face of the cover plate is concave.

34. The device of claim 28, wherein the third face of the cover plate is convex.

35. The device of claim 28, wherein at least one of the first bottom face and the second bottom face of the cover plate includes a ridge extending in a direction parallel to an elongated edge of the cover plate, whereby the ridge can engage a lateral edge of the first or second surface.

36. The device of claim 28, wherein at least one of the first bottom face and the second bottom face of the cover plate includes a notch extending in a direction parallel to an elongated edge of the cover plate, whereby the notch can engage a lateral edge of the first or second surface.

37. The device of claim 36, wherein the interior of the notch includes a protrusion extending in a direction parallel to the notch.

38. A method of installing an appliance having a lateral edge adjacent to a surface having a lateral edge, comprising:

positioning the appliance adjacent to the surface whereby the lateral edge of the appliance and the lateral edge of the surface are separated by a gap;

providing a pin having a head and a tip;

providing a cover plate having a first bottom face adapted to be positioned adjacent to the lateral edge of the appliance, a second bottom face adapted to be positioned adjacent to the lateral edge of the surface, and a top face generally opposite the first face and the second face, wherein the head of the pin is rotatably connected to the cover plate at one or more points between the first bottom face of the cover plate and the second bottom face of the cover plate; and inserting the tip of the pin into the gap until one of the first bottom face and the second bottom face of the cover plate engages one of the lateral edge of the appliance and the lateral edge of the surface; and rotating the cover plate relative to the pin until the other of the first bottom face and the second bottom face of the cover plate engages the other of the lateral edge of the appliance and the lateral edge of the surface;

whereby the cover plate spans the gap.

* * * * *